US006658804B2

(12) United States Patent
Leytes et al.

(10) Patent No.: US 6,658,804 B2
(45) Date of Patent: Dec. 9, 2003

(54) SELF-BEARING FLEXIBLE CURTAIN WALL SYSTEM

(76) Inventors: Vladimir S. Leytes, 1691 Canyon La., New Brighton, MN (US) 55112; Michael J. Smith, 863 Holton St., Saint Paul, MN (US) 55104; Xiaocong Gu, 244 Pine Ct., The Mews, Pittsburgh, PA (US) 15237

( * ) Notice: Subject to any disclaimer, the term of this patent is extended or adjusted under 35 U.S.C. 154(b) by 66 days.

(21) Appl. No.: 10/045,552

(22) Filed: Jan. 10, 2002

(65) Prior Publication Data

US 2003/0126813 A1 Jul. 10, 2003

(51) Int. Cl.[7] ..... E04H 9/02
(52) U.S. Cl. ..... 52/235; 52/167.1; 52/1
(58) Field of Search ..... 52/235, 167.1, 52/223.14, 223.7, 1

(56) References Cited

U.S. PATENT DOCUMENTS

| | | | | |
|---|---|---|---|---|
| 730,083 A | | 12/1903 | Hubert et al. | |
| 4,307,551 A | | 12/1981 | Crandell | |
| 4,471,584 A | * | 9/1984 | Dietrich | 52/14 |
| 4,545,161 A | | 10/1985 | Baumann | |
| 4,561,228 A | | 12/1985 | Kaminaga | |
| 4,565,040 A | | 1/1986 | Kaminaga | |
| 4,689,928 A | | 9/1987 | Dutton et al. | |
| 4,773,193 A | | 9/1988 | Biebuyck et al. | |
| 4,873,805 A | | 10/1989 | Ting | |
| 4,873,806 A | | 10/1989 | Jeschke | |
| 5,063,718 A | | 11/1991 | Nonis | |
| 5,520,236 A | | 5/1996 | Thomas et al. | |
| 6,032,423 A | | 3/2000 | Takemura et al. | |
| 6,170,214 B1 | | 1/2001 | Treister et al. | |
| 6,351,915 B1 | * | 3/2002 | Puckett | 52/167.1 |
| 6,519,903 B1 | * | 2/2003 | Dirisamer | 52/235 |

OTHER PUBLICATIONS

Cichonski, Walt, *A New Jewel for Philadelphia*, Glass Magazine, vol. 51, No. 2, Feb. 2001.
Goodall, David R., *The Pilkington Glass Wall System and Seismic Testing*, Building Design & Construction, Jun. 1992.
*'Pilkington Wall' 'Insulight' Structural Double Glazing System–'Planar Fitting'*, Pilkington Glass Limited, Nov. 1987.
Pilkington Architectural Planar System Structures, Pilkington Glass Limited.
Shanghai Communication Center, Fanbo Company, Inc., Select Architectural Structural Detail.

* cited by examiner

*Primary Examiner*—Carl D. Friedman
*Assistant Examiner*—Naoko Slack
(74) *Attorney, Agent, or Firm*—Nawrocki, Rooney & Sivertson, P.A.

(57) ABSTRACT

A self-bearing curtain wall system is provided, the system including a matrix of unitized kinematically integrated cladding panels flexibly joined to a structural member so as to thereby responsively anchor said matrix of unitized cladding panels. Adjacent cladding panels of the matrix of unitized cladding panels are responsively linked horizontally and vertically for horizontal and vertical rotation. Horizontally adjacent cladding panels of the matrix of unitized cladding panels are responsively joined to a cable type structural member via an anchor fixture, which allows the structural member to move freely along the wall.

24 Claims, 13 Drawing Sheets

SELF-BEARING FLEXIBLE CURTAIN WALL SYSTEM

TECHNICAL FIELD

The present invention relates to curtain walls, and more particularly to a self-bearing flexible curtain wall system for cladding a structure.

BACKGROUND OF INVENTION

In the construction of enclosed buildings, it is generally most efficient to construct the columns, floors, roof, and internal supporting walls initially, and, thereafter to enclose the structure by constructing the exterior walls. A curtain wall system is an exterior wall system (i.e., a cladding) installed outboard of the building perimeter frame to provide protections against the exterior weather conditions. In addition to a traditional utilitarian function, curtain wall systems are further called upon to satiate aesthetic functionality.

Curtain wall systems are generally of two varieties, namely "stick" or "unitized." The stick curtain wall system is one in which the primary structural framing components are erected individually in the field, with vertical mullions typically attached to the floor slabs, with horizontals subsequently attached to the vertical mullions. Thereafter, the vision glass and spandrel materials are field installed into the assembled grid work.

The unitized curtain wall system is one in which the framing members are preassembled and erected in modules of a manageable size and weight. The wall modules are of a height generally equal to the building's storey height. The assembled and pre-glazed modules are supported by connectors upon the outer area of the building floor. Modules are stacked upon each other in parallel rows, and adjacent modules are often connected together by means of male-female interlocking. Vertical and horizontal mating joints can either be dry-sealed with gaskets, or wet-sealed with field supplied sealants. Needless to say, quite a variety of techniques and hardware are available to generally fasten the wall modules to the structural elements of a building, in addition to the wide variation in constructing the modules in the first instance.

Although modules may be constructed as load bearing exterior walls, higher buildings require that each building floor support a row of modules of a height equal to the building's storey height. The exterior wall system is normally supported on spaced apart vertical mullions. The vertical mullions are structurally connected to the building perimeter frame to provide two structural functions, namely to support the dead weight of the exterior wall system, and to resist reaction forces transmitted from the exterior wall system due to lateral (wind and/or earthquake) loads. Commonly used anchorage placements for joining the mullions to the building are located along the edges of the roof and floor slabs. In addition to lateral load resisting requirements, the functional requirement of the curtain wall includes water tight performance and maintaining a certain degree of air tightness for the consideration of thermal efficiency. An important consideration towards this end, is the effect of the relative deflection along the edges of the slabs between floors due to the variable live loads and the effect of building frame interstory movements due to lateral forces.

As architects continue to be called upon to design more aesthetically pleasing structures, and advances are made in cladding technology/material science, structural soundness, typically manifest in the form of economic viability/ feasibility, remains the touch stone of cladding innovation. For example, structures such as the Philadelphia Regional Performing Arts Center, presently under construction, and the Shanghai Communication Center evidence the advances being made in cladding systems, more particularly in the area of glazed elements supported by a system of prestressed cables. Be this as it may, there remains a need for a self-bearing flexible curtain wall system, more particularly, a system wherein a matrix of kinematically integrated cladding panels includes vertically adjacent panels which are load bearing (i.e., dead load is transferred down along the vertical linkages between vertically adjacent panels).

SUMMARY OF THE INVENTION

A self-bearing flexible curtain wall system is provided, the system including a matrix of unitized kinematically integrated cladding panels flexibly joined to a structural member as for example, a prestressed, substantially vertical, cable or cable like element (e.g., rod, bar, etc.). Adjacent cladding panels of the matrix of unitized cladding panels are responsively linked horizontally and vertically for horizontal and vertical rotation. Horizontally adjacent cladding panels of the matrix of unitized cladding panels are responsively joined to a structural member via an anchor fixture, which allows the cladding panels to remain in a substantially static condition when the cables move along wall elevation due to main structure movement and/or distortion. More specific features and advantages will become apparent with reference to the DETAILED DESCRIPTION OF THE INVENTION, appended claims, and the accompanying drawing figures.

DETAILED DESCRIPTION OF THE INVENTION

Figure 1:
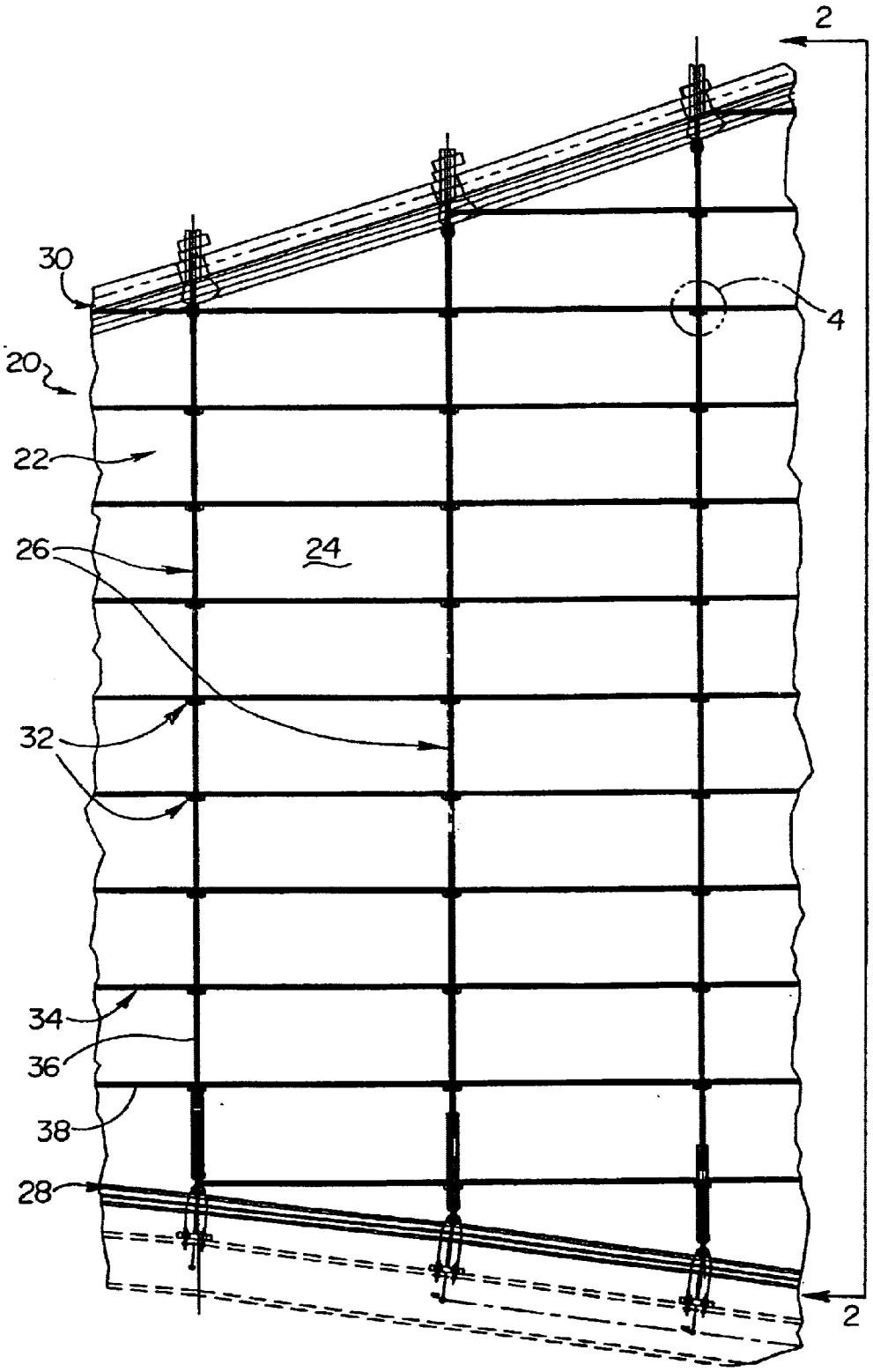
FIG. 1 is a partial elevation view of the self-bearing flexible curtain wall system of the subject invention.
Figure 2:
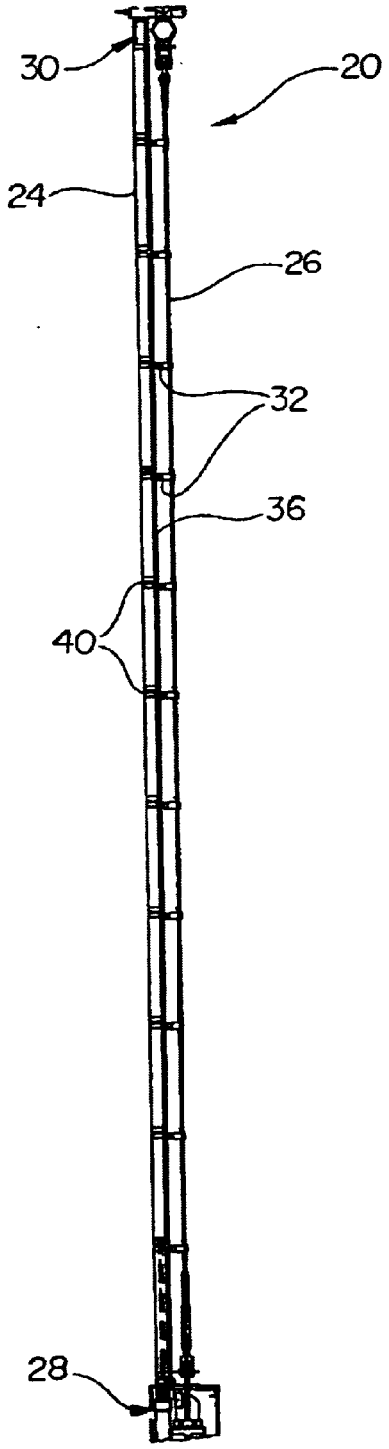
FIG. 2 is a cross-section view of the cladding of FIG. 1 taken about line 2—2.

Referring generally to FIGS. 1 & 2, a self-bearing flexible curtain wall system 20 is shown in partial plan and cross-section, respectively. The self-bearing curtain wall system 20 of the subject invention includes a matrix or array 22 of unitized cladding panels 24 (i.e., rows and columns of unitized cladding panels), adjacent cladding panels of the matrix 22 being responsively linked horizontally and vertically for horizontal and vertical rotation. Horizontally adjacent cladding panels of the matrix 22 of unitized cladding panels 24 are further united and collectively, flexibly joined to a structural member 26 (e.g., prestressed cables tensioningly extending, i.e., anchored, between the sills 28 and heads 30 of a building so supported) by an anchor fixture 32 so as to thereby responsively anchor the matrix 22 of unitized cladding panels 24. The self-bearing flexible curtain wall system 20 of the subject invention is especially well suited for buildings with sidewalls of prestressed cables of various lengths and levels of prestress. Under normal to the wall lateral forces, the cables each deflect differently in response thereto, and the matrix 22 of unitized cladding panels 24 assumes an irregular curvature in section and in plan as will be subsequently discussed.

Each panel 24 of the matrix 22 of unitized cladding panels includes a periphery 34 comprising opposingly paired vertical 36 and horizontal 38 members, more particularly left 36*a* and right 36*b* paired members, and upper (i.e., head) 38*a* and lower (i.e., sill) 38*b* paired members. As previously noted, each of the panels 24 of the matrix 22 of unitized cladding panels are kinematically integrated, with groups of integrated panels (i.e., horizontal panel pairs) responsively anchored to the structural member 26 by the anchor fixture 32.

Kinematic panel integration is accomplished by vertical 40 and horizontal 42 linkage assemblies. Vertical linkage assemblies 40 operatively interposed between adjacent horizontal members 38 of vertically adjacent cladding panels 24 (i.e., a head 38*a* to sill 38*b* linkage) permit rotation in section of the cladding panels. Further details of the vertical linkage assembly 40 will be presented with respect to a discussion of FIGS. 4–8. Horizontal linkage assemblies 42 operatively interposed between adjacent vertical members 36 of horizontally adjacent cladding panels 24 permit rotation in plan of the cladding panels. Further details of the horizontal linkage assembly 42 will be presented with respect to a discussion of FIGS. 9–13.

Figure 3:
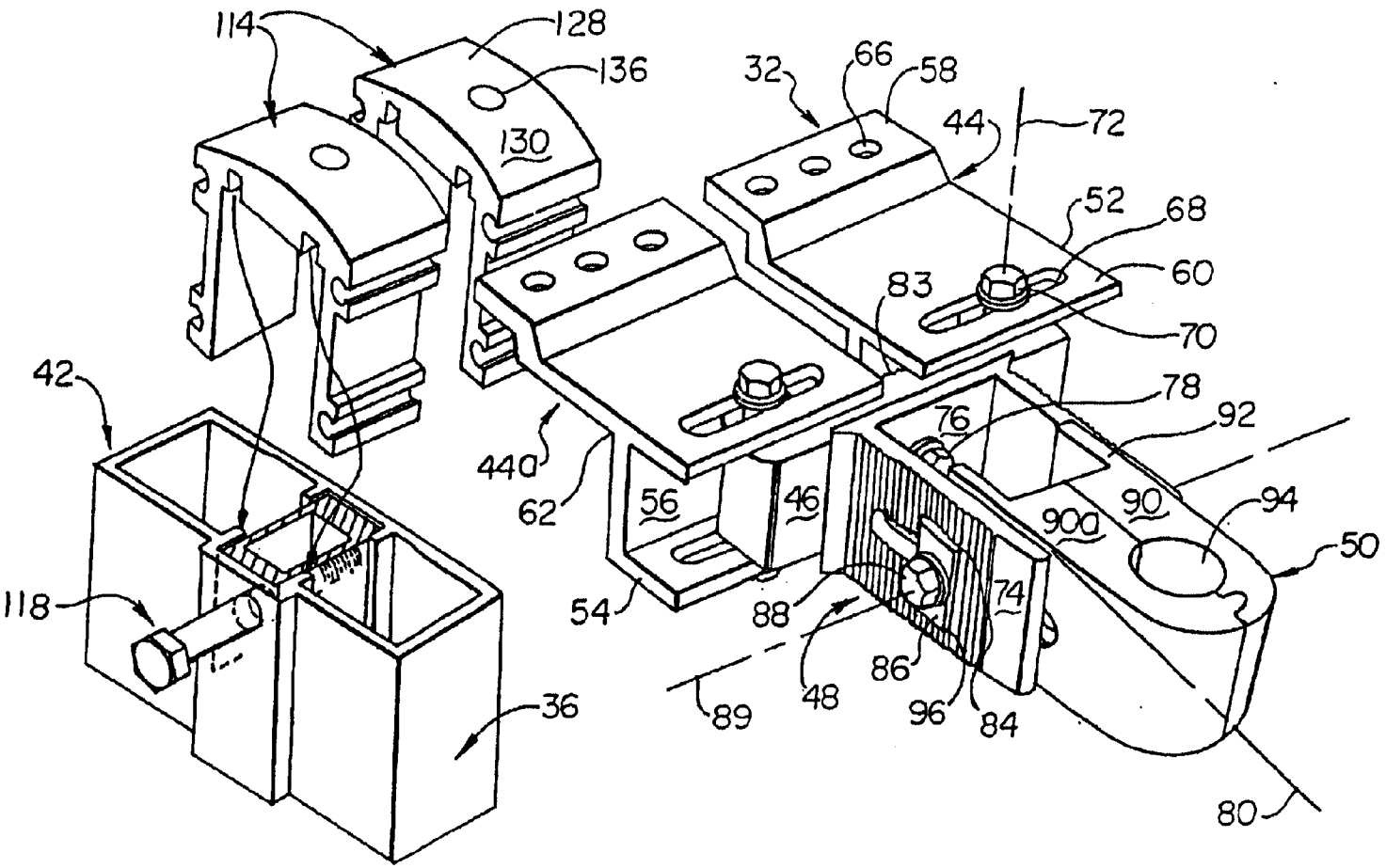
FIG. 3 is a perspective overhead view of elements of the self-bearing flexible curtain wall system of the subject invention.
Figure 4:
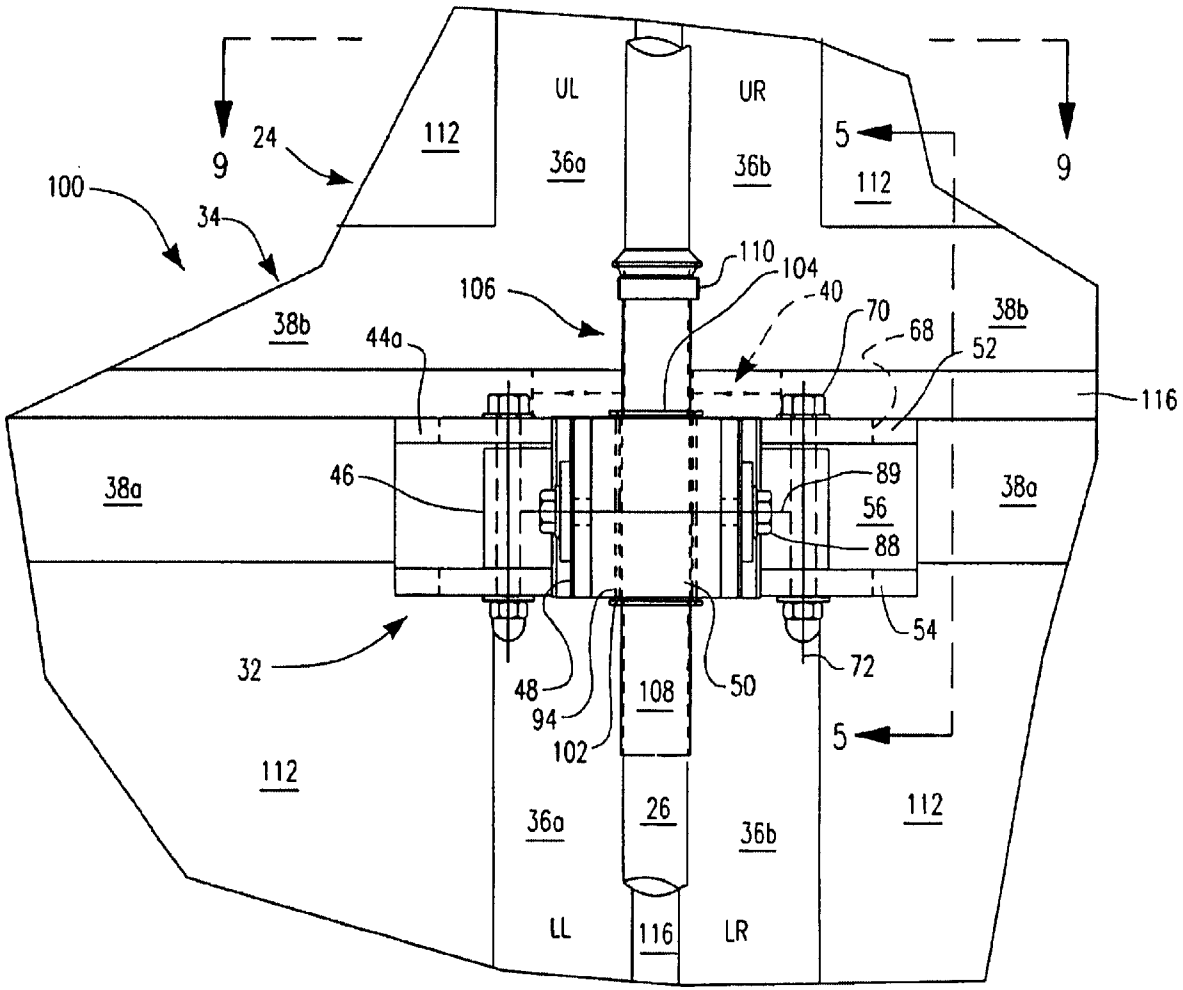
FIG. 4 is an enlarged view of area 4 of FIG. 1.
Figure 5:
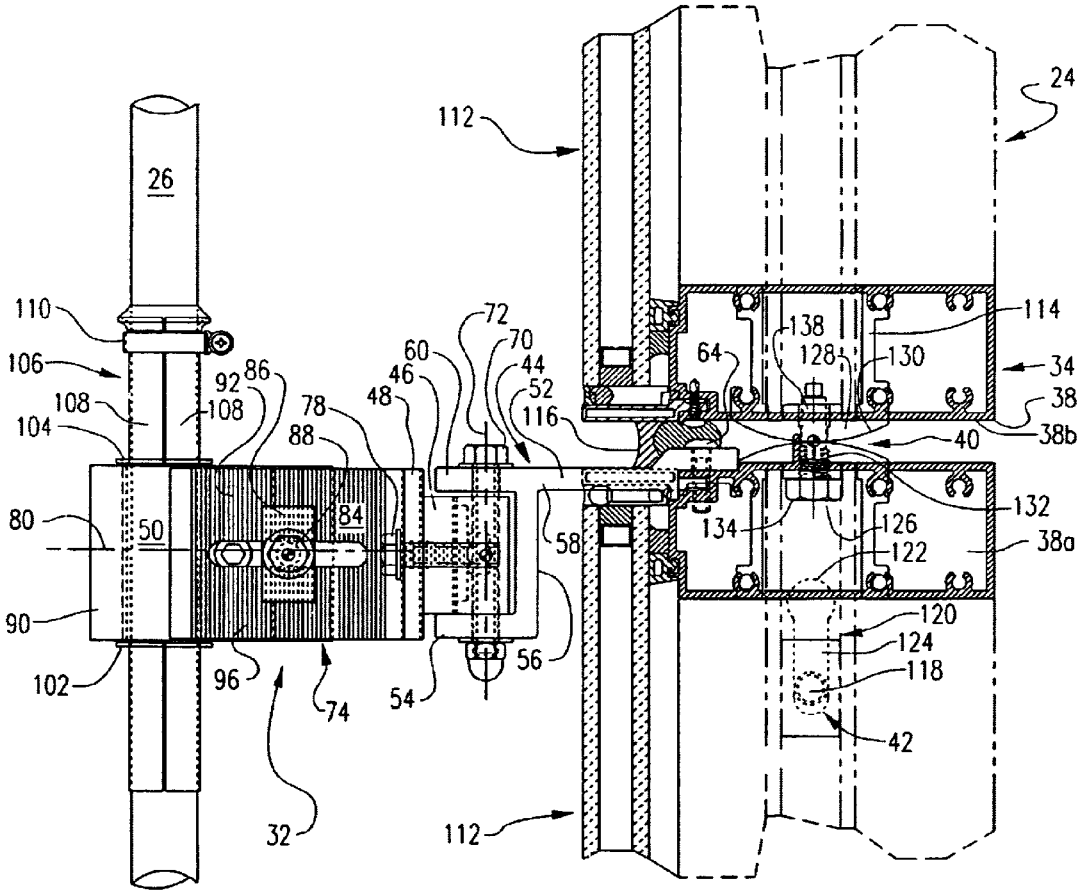
FIG. 5 is a cross-section view of components of the self-bearing curtain wall system of the subject invention taken about line 5—5 of FIG. 4, anchoring normal to a structural element.

Referring now generally to FIGS. 3–5, the anchor fixture 32 of FIG. 1 is shown (FIG. 4) rigidly affixed at one end to the upper horizontal members (i.e., heads) 38*a* of horizontally adjacent cladding panels 24, and slidingly affixed at the other end, at least indirectly, to the prestressed cable 26. The anchor fixture 32 generally includes (FIG. 3) a pair of cladding brackets 44/44*a*, a yoke 46 pivotably supporting the bracket pair 44/44*a*, an anchor bracket 48 pivotably supporting the yoke 46, and a clamp 50, adapted to engage the prestressed cable 26, pivotably supporting the anchor bracket 48.

The anchoring or tethering of the kinematically integrated matrix 22 of unitized cladding panels 24 to or with the prestressed cables 26 are made in such a way to permit the cables 26 to move freely along the curtain wall (i.e., left/right in FIG. 1) while not involving the panels 24 of the matrix 22 in such motion. Furthermore, this union allows some angle of rotation between the cable 26 and adjacent panels in elevation, some angle of rotation between adjacent panels in plan and elevation, and some spread (i.e., joint elongation) between adjacent units in plan.

With particular emphasis on FIG. 3, each cladding bracket 44/44*a* of the pair of cladding panel brackets generally includes top (i.e., upper) 52 and bottom (i.e., lower) 54 flange portions spaced apart by a webbing 56. The top flange portion 52 has forward 58 and rearward 60 extending segments (i.e., opposingly extending segments with respect to the webbing 56), the head 38*a* of the cladding panel 24 being abuttingly receivable in a crotch 62 defined by the union of the webbing 56 with the top flange 52, more particularly the forward portion 58 thereof. The cladding brackets 44/44*a* are affixable to the heads 38*a* of horizontally adjacent panels 24 using conventional fasteners 64 (FIG. 5) receivable in spaced apart apertures 66 near the free ends of the forwardly extending segments 58 of the upper flanges 52 of the cladding brackets 44/44*a*.

Each cladding bracket 44/44*a* of the pair of cladding panel brackets is vertically pivotable and horizontally translatable upon the yoke 46 so as to accommodate flexure of the horizontally adjacent panels, more particularly, relative rotation and spread therebetween. The rearwardly extending segments 60 of the upper flanges 52, and the lower flanges 54 of the cladding brackets 44/44*a* include opposingly paired slots 68. At least some portion of the yoke 46, depending upon the spread between horizontal panels being accommodated (as will be later discussed with respect to FIGS. 10–15), is interposed between the rearwardly extending segments 60 of the upper flanges 52, and the lower flanges 54 of the cladding brackets 44/44*a*. The opposingly paired slots 68 are receivable upon vertical through bolts 70 carried at opposing ends of the yoke 46, thereby permitting rotation along the entire length of the slot for each horizontally adjacent panel about a vertical axis 72 defined by the vertical through bolts 70.

The anchor bracket 48, which pivotingly supports the yoke 46, is generally configured so as to be "U" shaped, having a pair of opposed legs 74 extending from a webbing (i.e., closed end) 76. A horizontal through bolt 78 or the like joins the anchor bracket 48, at the webbing 76, to the yoke 46, thereby defining a horizontal axis of rotation 80 therebetween. The yoke 46 is preferably longitudinally adjustable relative to the anchor bracket 48, the horizontal through bolt 78 being received in a longitudinal slot 82 (FIG. 9) of the yoke 46 and being secured thereto in known ways, as for instance via the cooperation of a serrated surface 84 of the yoke 46 with a serrated surface 83 of a locking element 86 carried by the horizontal through bolt 78.

Vertical dimensions of the yoke 46 are somewhat smaller than the opening between flanges 52 and 54 so as to accommodate some mutual rotation in the plane wall for two horizontally adjacent panels. The clamp 50, which pivotingly supports the anchor bracket 48 via a horizontal through bolt 88 (which defines an axis of rotation 89 for the anchor bracket 48 about the clamp 50), preferably includes two joined or joinable halves 90/90*a*, for instances male and female elements joined by mechanical means (note FIG. 10), to facilitate engagement of the anchor fixture 32 to the structural member 26. Each element 90/90*a* of the clamp 50 includes an apertured flange 92 and a profiled portion 94, indirectly through a frictionless sleeve receiving the prestressed cable 26. As the yoke 46, the opposed legs 74 of the anchor bracket 48 include longitudinal slots 82 for longitudinal adjustment of the anchor bracket 48 relative to the clamp 50 (i.e., the distance between the panels 24 of the matrix 22 of unitized cladding panels and the prestressed cable 26 can be accommodated). Surfaces 96 of the opposed legs of the anchor bracket are preferably serrated so as to cooperatively engage a serrated surface 84 of a locking element 86 in furtherance of affixation of the anchor bracket 48 to the clamp 50.

With regard to hardware associated with the subject self-bearing curtain wall system, the primary structural elements of FIG. 3, such as the anchor fixture 32, vertical linkage assembly 40, and horizontal linkage assembly 42 are preferably aluminum extrusions. These elements may be finished consistent with aesthetic considerations and maintenance requirements. A horizontal connection assembly 42 shows horizontal pin/bolt 118 nested inside vertical member 36 by means of a tapped short box which embraces the pin. (See also FIG. 11).

With particular emphasis on FIG. 4, a group or grouping 100 of kinematically integrated panels 24, more particularly, upper left (UL)/right (UR) and corresponding lower left (LL)/right panels (LR), is shown anchored to the structural element 26. The anchor fixture 32 of FIG. 3 is shown in sliding engagement with the prestressed cable 26, more particularly, an ultra high molecular weight plastic slip sleeve 102 having flared opposing ends 104 is illustrated interposed between the clamp 50 and the cable stay 106 so as to facilitate vertical translation of the anchor fixture 32 relative to the cable. The cable stay 106 preferably includes paired metallic/plastic tubing halves 108 affixed to the cable 26 via a compression clamp 110.

Glazing 112 or other suitable cladding material is supported within the periphery of the panel or otherwise integral thereto, more particularly between the vertically 36 and horizontally 38 opposed panel members (e.g., mullions). Vertical and horizontal mullions (i.e., framing) of the glazed panel must be mutually attached at corresponding corners by means of a moment-resistant connection so as to resist any forces acting along the elevation. In the case of a metallic panel, adequate connection of the panel to the framing is required. Adjacent heads 38*a* and sills 38*b* are shown united by components of the vertical linkage assembly 40, namely opposingly paired brackets 114 (see also FIGS. 3 and 5). The brackets 114 are preferably integral to the opposing vertical members 36 of the adjacent panels 24 as will be later illustrated and discussed. Weather protection seal 116 (i.e., the exterior component of the exterior sealing system) are interposed between adjacent panels.

Referring now generally to FIGS. 5–8, the interrelatedness of vertically adjacent kinematically linked panels, more specifically the elements of the self-bearing curtain wall system of the subject invention, is evidenced. To a lesser extent, elements of the horizontal linkage assembly 42 are shown, more particularly the horizontal pin 118 thereof is shown (FIG. 5) resting in a key way 120 comprising a pin entry aperture 122 and a pin slot 124 extending downwardly therefrom. The key way 120 is preferably integral to the opposingly paired vertical members or mullions 36 of the horizontally paired panels as will be subsequently detailed with respect to a discussion of FIGS. 9–13, and the notion of spread.

Figure 6:
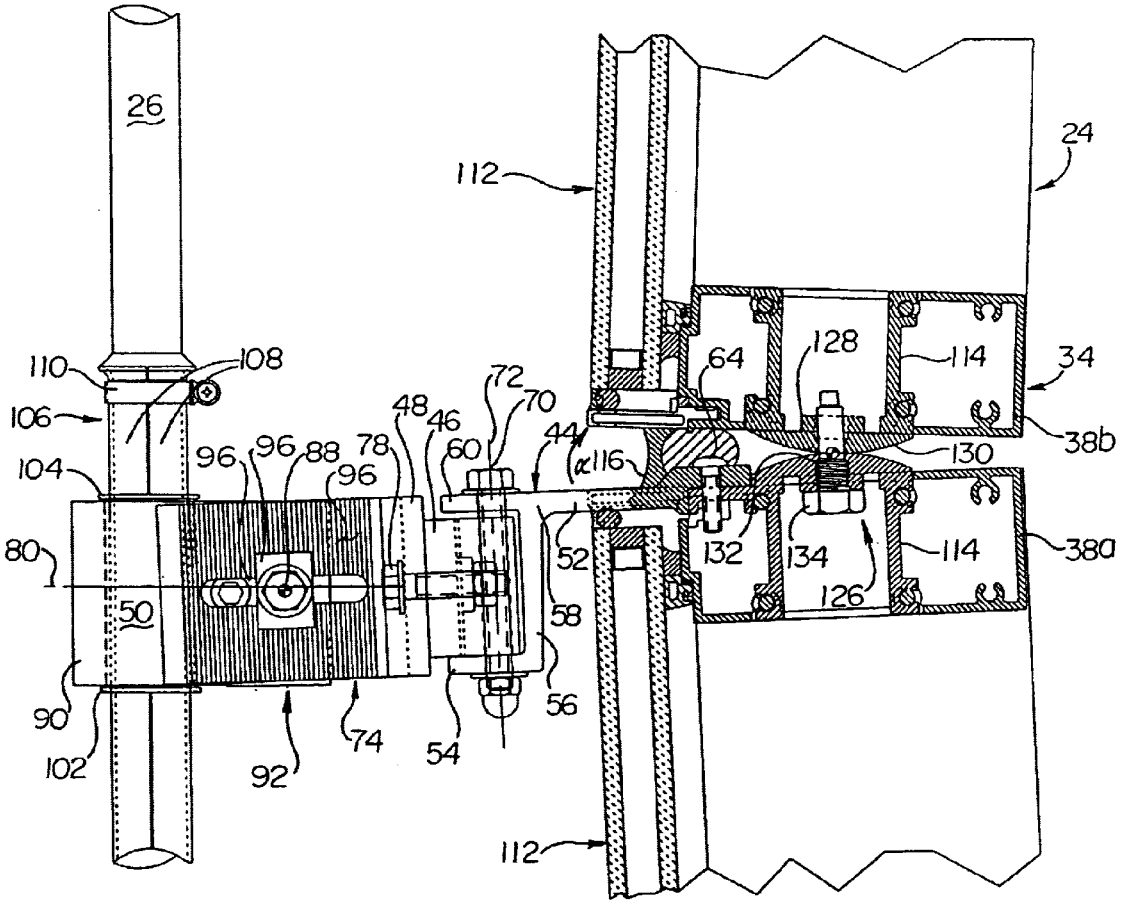
FIG. 6 is a view as FIG. 5, particularly illustrating horizontal rotation of vertically adjacent cladding panels, the exterior sealing assembly in expansion, anchoring negatively deviating from normal.
Figure 7:
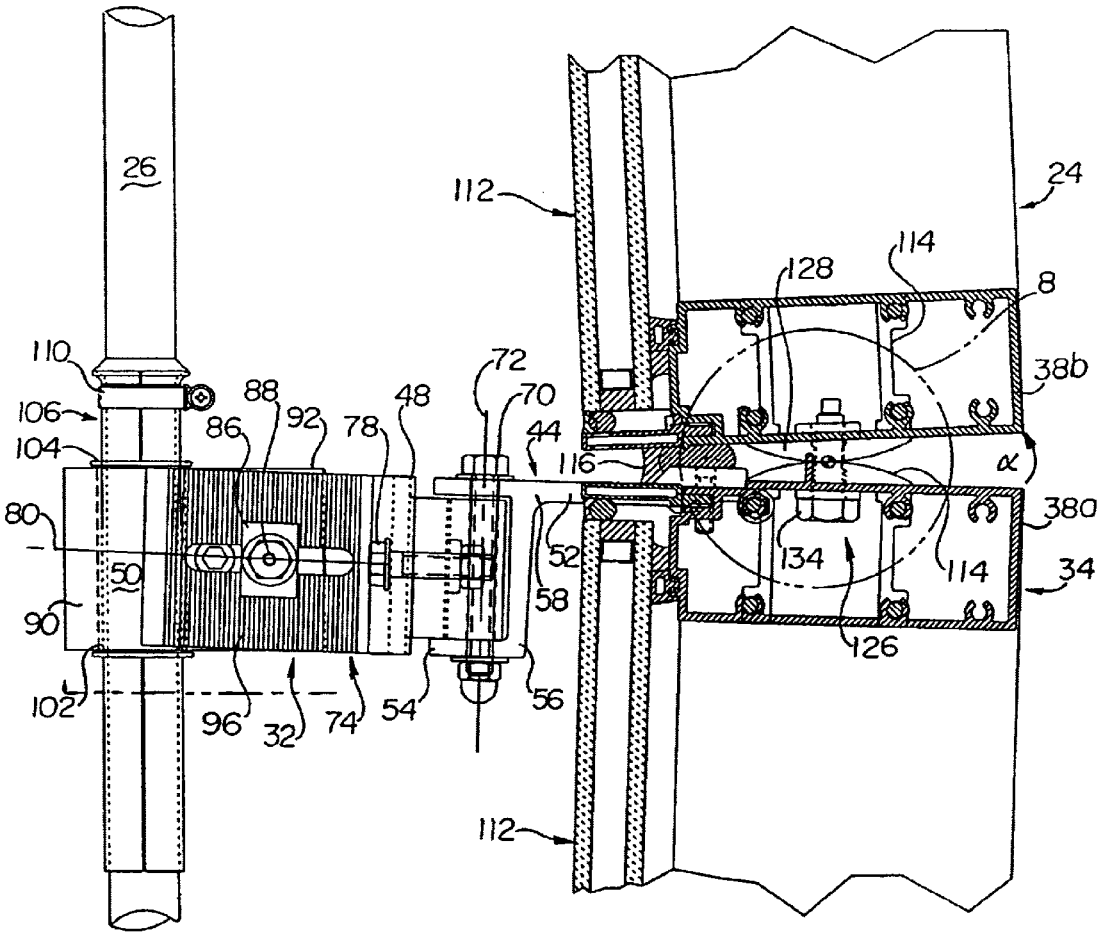
FIG. 7 is a view as FIG. 5, particularly illustrating horizontal rotation of vertically adjacent cladding panels, the exterior sealing assembly in compression, anchoring positively deviating from normal.

The nature of the anchoring or tethering of the kinematically integrated matrix of unitized cladding panels to or with the prestressed cables, more particularly the nature of the vertical interrelatedness of the anchor fixture elements 32 (i.e., the cladding panel brackets 44/44*a*, yoke 46, anchor bracket 48, and clamp 50) is likewise appreciated upon review of FIGS. 5–7. FIG. 5 illustrates a portion of the matrix of unitized cladding panels in a condition or configuration substantially normal to the structural element; FIG. 6 illustrates horizontal rotation ($\alpha$~4°) of vertically adjacent cladding panels, a joint seal in expansion and anchoring negatively deviating from normal (i.e., above the horizon); and, FIG. 7 illustrates horizontal rotation ($\alpha$~4°) of vertically adjacent cladding panels, the joint seal in compression and anchoring positively deviating from normal (i.e., below the horizon). As previously noted with respect to FIG. 3, the anchor fixture 32 includes a cladding panel bracket pivot 72, a yoke pivot 80, and an anchor bracket pivot 89, rotation about the anchor bracket pivot 89 being especially illustrated in the subject views.

Figure 8:
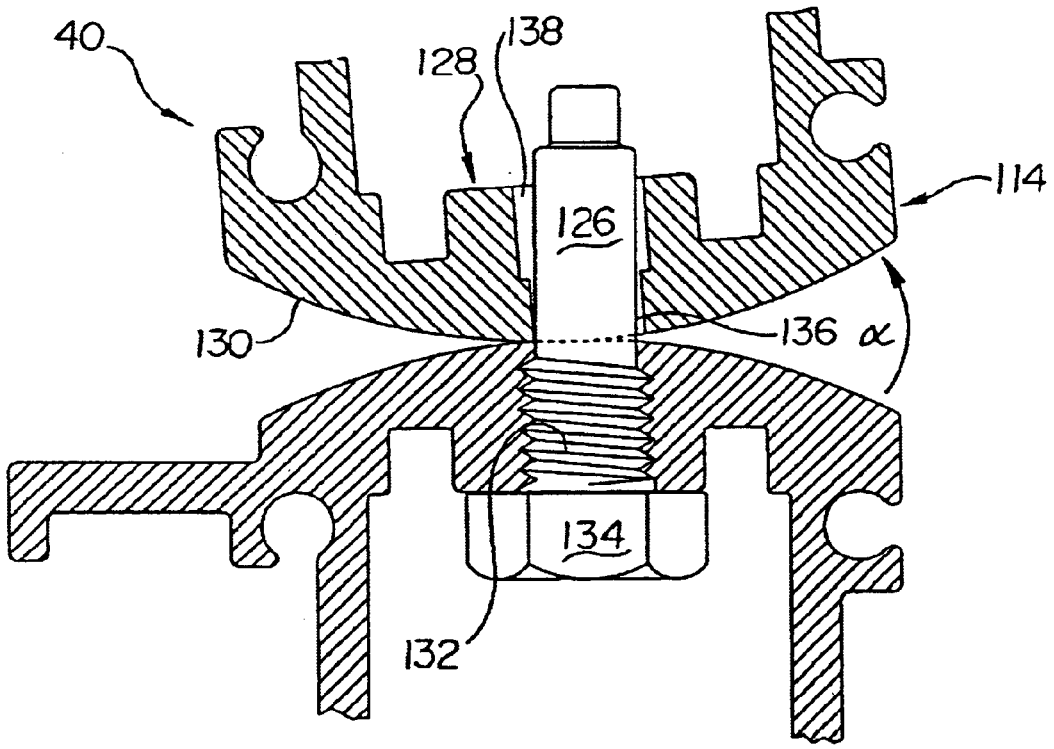
FIG. 8 is an enlarged view of area 8 of FIG. 7, particularly showing elements of the vertical linkage assembly.

The vertical linkage assembly 40 generally includes opposingly paired brackets 114 and a vertical pin 126 receivable through a webbing 128 of each of same. The webbing 128 of each of the opposingly paired brackets 114 includes a convex exterior surface 130, the horseshoe style brackets 114 arranged to be in abutting engagement, convex surfaces 130 in opposition, in the vertical linkage assembly 40 (FIG. 8). The head horseshoe 114 is shown having a portion of the pin 126 secured thereto (i.e., threads 132 adjacent a bolt head 134 are threadingly received within the webbing 128 of the horseshoe 114 of the upper horizontal member 38*a* of the lower panel of the vertically aligned panel pair so as to be integral therewith). An aperture 136 of the webbing 128 of the sill horseshoe 114 includes an enlarged portion 138, distal of the convex surface 130 thereof, so as to accommodate rotation of the upper panel relative to the lower panel (i.e., rocking of the sill bracket upon the head bracket). The horseshoe-like brackets 114 of the vertical linkage assemblies 40 are generally carried by the adjacently paired vertical members 36*a* of the periphery 34 of each panel 24 of the matrix 22 of unitized cladding panels, more preferably, the horseshoes 114 are integral to the vertical mullions 36 of the glazed panels 24 (see FIGS. 3 and 5).

The vertical linkage assemblies 40, and joints formed thereby, transfer dead load all the way along the verticals, with the vertical pin 126 transferring lateral load between vertically adjacent panels and allowing the required angle of rotation in section to accommodate cable curvature (see FIGS. 6 & 7). In this way, and by such interrelatedness, the matrix 22 of unitized cladding panels 24 is self supported, more particularly, each column of panels 24 within the matrix 22 is self-bearing.

Figure 9:
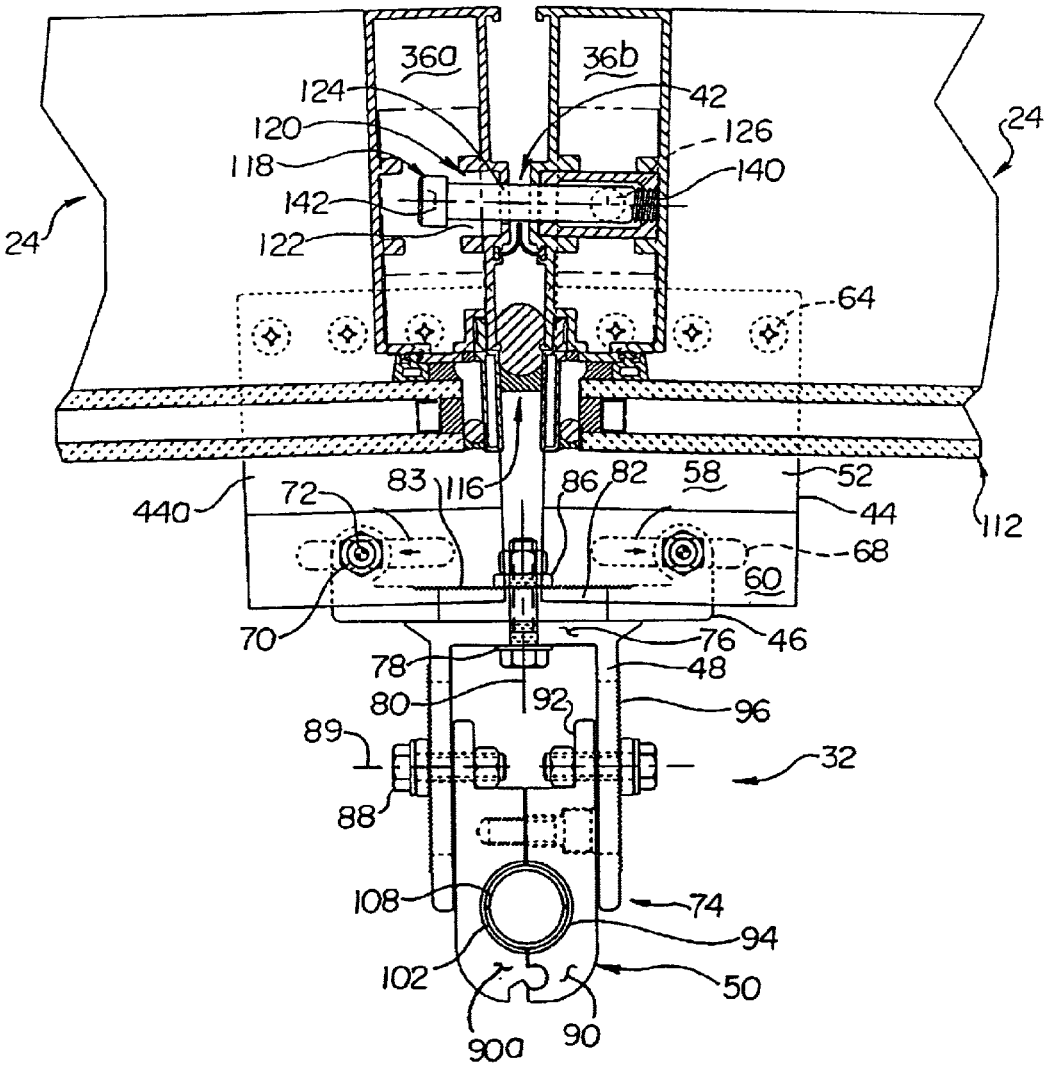
FIG. 9 is a cross-section view of components of the self-bearing flexible curtain wall system of the subject invention taken about line 9—9 of FIG. 4, particularly showing vertical rotation of horizontally adjacent cladding panels, the exterior sealing assembly in compression with spread exhibited.
Figure 10:
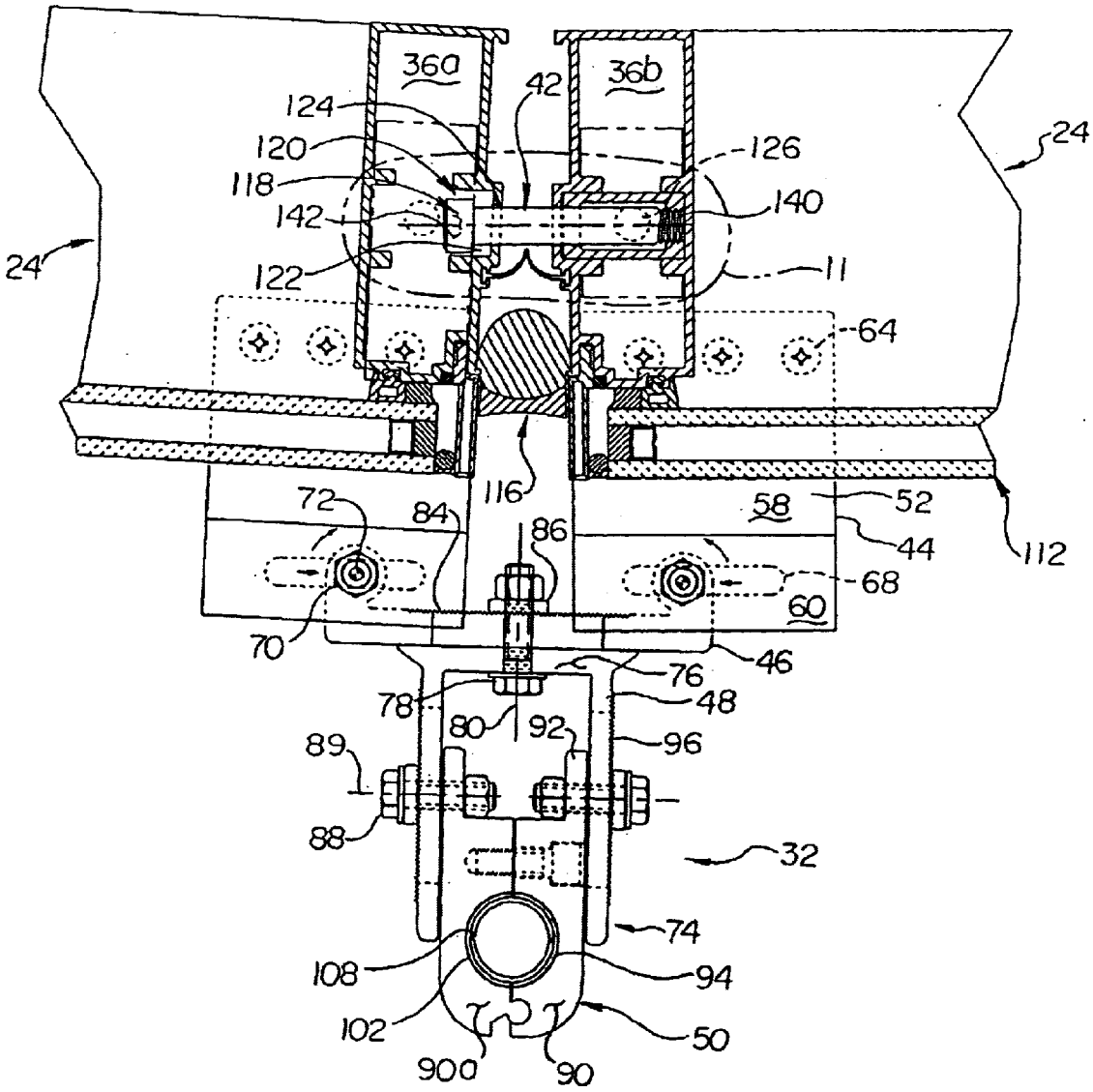
FIG. 10 is a view as FIG. 9, particularly showing vertical rotation of horizontally adjacent cladding panels, the exterior sealing assembly in expansion with approach exhibited.
Figure 11:
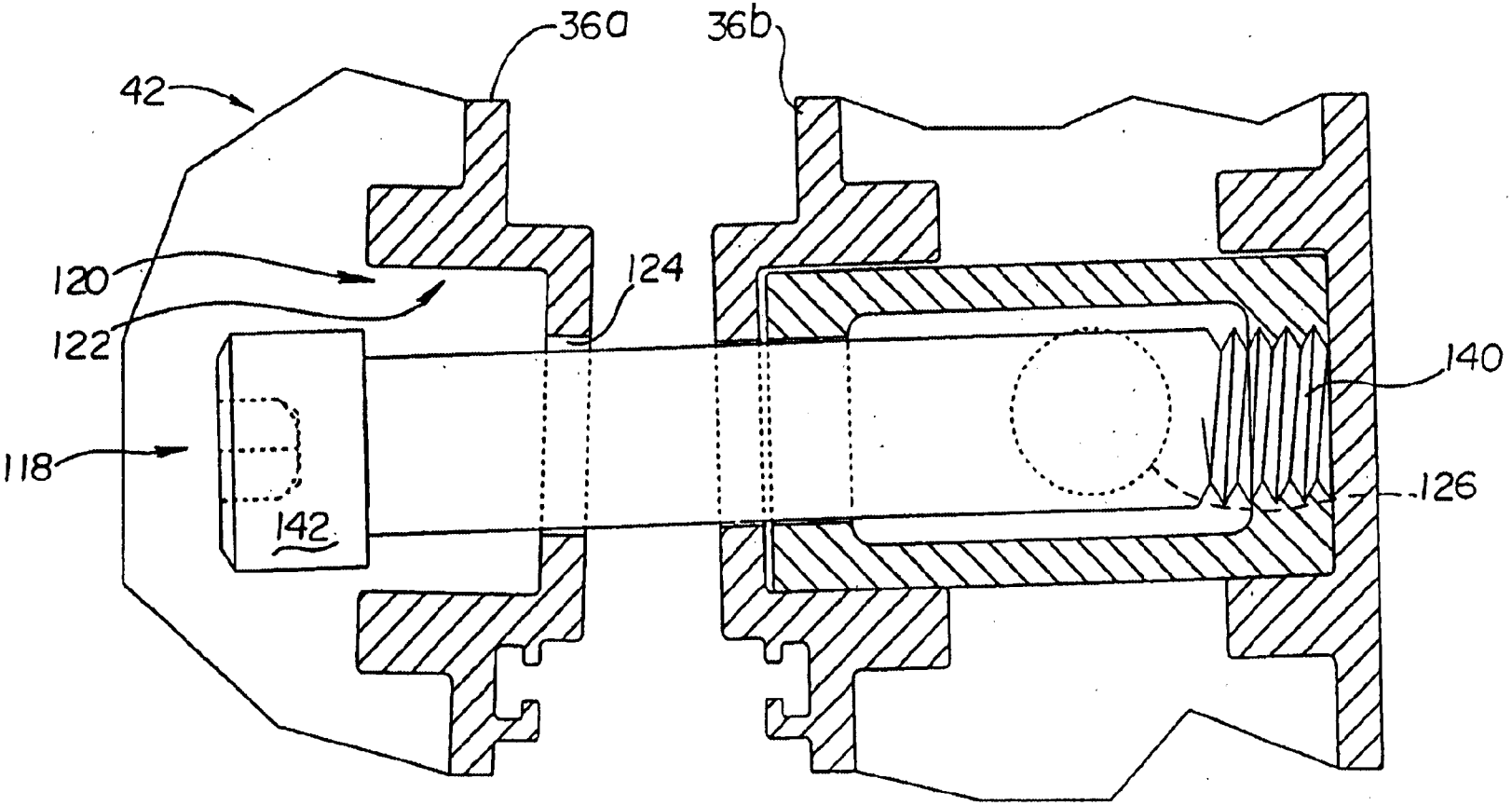
FIG. 11 is an enlarged view of area 11 of FIG. 10, particularly showing an embodiment of the horizontal linkage assembly of the subject invention.

Referring now to FIGS. 9–13, the nature of horizontally adjacent panel integration is shown, namely, the combination of the previously described anchor fixture 32 (i.e., the cladding panel bracket 44/44*a* interface with the heads 33*a* of horizontally adjacent panels) and the horizontal linkage assemblies 42. The nature of the anchoring or tethering of the kinematically integrated matrix of unitized cladding panels to or with the prestressed cables, more particularly the nature of the horizontal interrelatedness of the anchor fixture 32 elements (i.e., the cladding panel brackets 44/44*a*, yoke 46, anchor bracket 48, and clamp 50) is likewise appreciated upon review of FIGS. 9 & 10. FIG. 9 illustrates vertical rotation of horizontally adjacent cladding panels, the weather seal in compression and spread exhibited (i.e., the right cladding panel bracket 44 rotating clockwise about its cladding panel bracket pivot 72 and to the right with respect thereto as indicated by the arrow; the left cladding panel bracket 44*a* rotating counter clockwise about its cladding panel bracket pivot 72*a* and to the left with respect thereto as indicated by the arrow); and, FIG. 10 illustrates vertical rotation of horizontally adjacent cladding panels, the weather seal in expansion and approach exhibited (i.e., the right cladding panel bracket 44 rotating counter clockwise about its cladding panel bracket pivot 72 and to the left with respect thereto as indicated by the arrow; the left cladding panel bracket 44*a* rotating clockwise about its cladding panel bracket pivot 72 and to the right with respect thereto as indicated by the arrow).

The horizontal linkage assembly 42 generally includes a pin or rod 118, the opposingly paired vertical members 36 (e.g., mullions) being adapted to receive opposing portions thereof. As shown generally in FIGS. 9–10 and more particularly in FIG. 11, the pin 118 (e.g., bolt) preferably includes a threaded end 140 opposite a head 142. It is preferable but not necessary that at least one of the opposingly paired vertical members 36 be adapted to retain at least one of the end portions of the pin 118 (e.g., head), for example by the irregular key way 120, specifically the slot 124 through which the end portion of the pin cannot pass, as was discussed in relation to FIG. 5. This style configuration is especially appropriate in seismic regions, where spread will result in catastrophic cladding failure. Likewise, the irregular key way 120 configuration greatly facilitates assembly of panel rows, the enlarged end portion 142 of the pin 118 being easily initially received within the pin entry aperture 122 and subsequently positioned within slot 124. It is further preferable that the opposingly paired vertical members 36 are further adapted to secure at least one of the opposing portions of the pin 118, as is the case for instance wherein at least one of the opposing portions of the pin 118 (e.g., bolt) is threaded for retention or anchoring by one of the opposingly paired vertical members 36.

As is readily apparent from review of FIGS. 9 & 10, it is critical that the horizontal linkage assembly 42 be able to accommodate the degree of spread (i.e., joint elongation) between horizontally adjacent panels. It may readily be appreciated that, under a variety of commonly encountered scenarios, the design spread may warrant a special linkage configuration, for instance the horizontal linkage assemblies of FIGS. 12 & 13.

Figure 12:
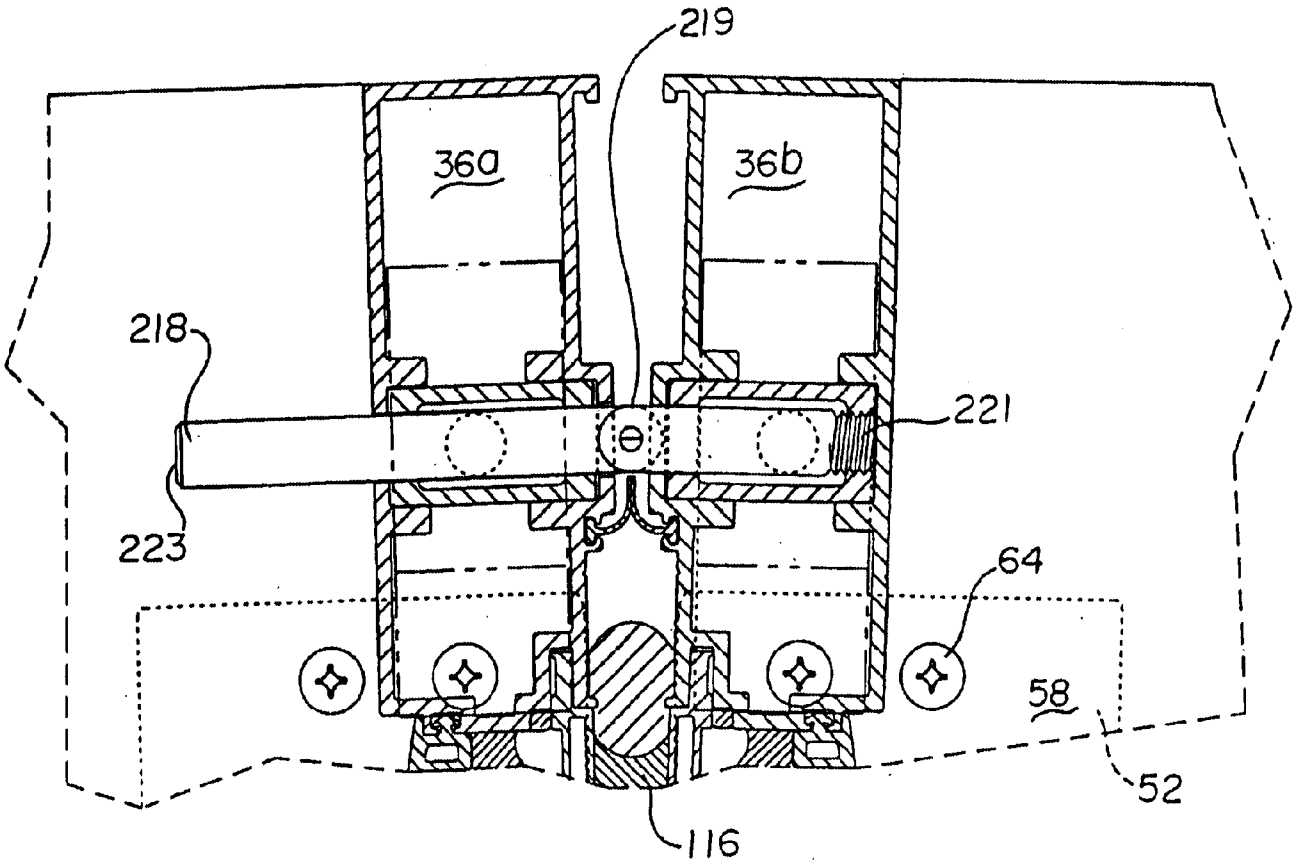
FIG. 12 is a partial view of the horizontal adjacent cladding panels of FIG. 9 particularly illustrating an alternate embodiment of the horizontal linkage assembly of the subject invention; and, FIG. 13 is a partial view of the horizontal adjacent cladding panels of as FIG. 9 particularly illustrating a further alternate embodiment of the horizontal linkage assembly of the subject invention.
Figure 13:
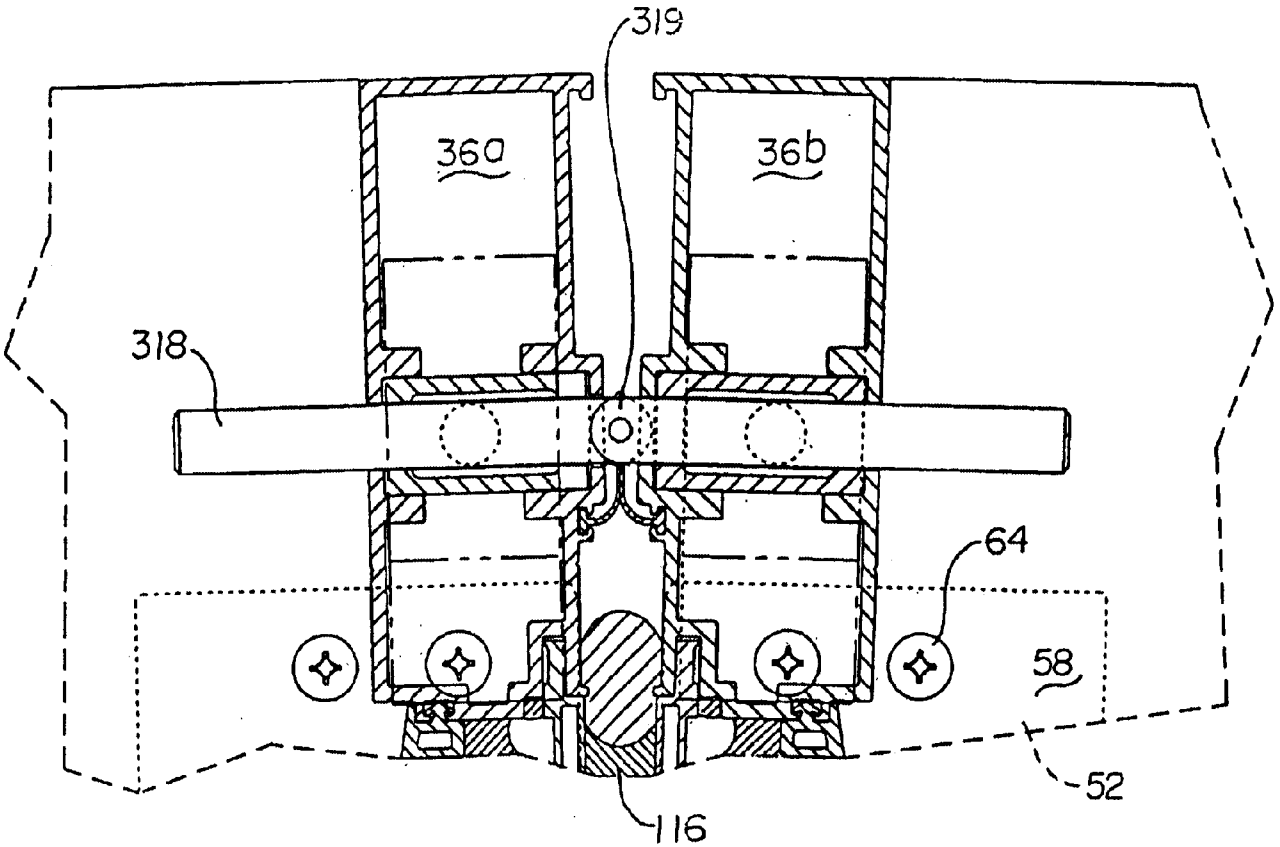

Referring now to FIGS. 12 & 13, an articulated pin or rod 218, 318 respectively is shown, opposing portions thereof being generally receivable in opposing portions of adjacent vertical mullions 36. The pin 218 is arranged in the horizontal linkage assembly 42 such that the joint (i.e., hinge) 219 of the pin 218 is interposed between the adjacent vertical mullions 36 (i.e., horizontally adjacent panels). The rod 218 of the embodiment of FIG. 12 is secured to the mullion 36, as for instance by the integration of threads 221 of the rod end 223 with that portion of the mullion 36 adapted to receive same, whereas the rod 318 of the embodiment of FIG. 13 is not secured to either vertical mullion 36, however, the rod length is sufficient such that opposing portions thereof will remain engaged with the portion of the mullion 36 adapted to receive same. Although the specific horizontal linkage assemblies of FIGS. 11–13 have been disclosed, variations thereof in the context of the subject self-bearing flexible curtain wall system are contemplated.

It will be understood that this disclosure, in many respects, is only illustrative. Changes may be made in details, particularly in matters of shape, size, material, and arrangement of parts without exceeding the scope of the invention. Accordingly, the scope of the invention is as defined in the language of the appended claims.

What is claimed is:

1. A self-bearing flexible curtain wall system comprising a matrix of unitized cladding panels, adjacent cladding panels of said matrix of unitized cladding panels being responsively linked horizontally and vertically for horizontal and vertical rotation, horizontally adjacent cladding panels of said matrix of unitized cladding panels being flexibly joined to a structural member so as to thereby responsively anchor said matrix of unitized cladding panels, the structural member thusly independently moveable along said self-bearing flexible curtain wall system.

2. The self-bearing flexible curtain wall system of claim 1 wherein each panel of said matrix of unitized cladding panels includes a periphery comprising opposingly paired vertical and horizontal members.

3. The self-bearing flexible curtain wall system of claim 2 wherein a vertical linkage assembly is operatively interposed between adjacent vertical members of vertically adjacent cladding panels.

4. The self-bearing flexible curtain wall system of claim 3 wherein said vertical linkage assemblies transfer deadloads.

5. The self-bearing flexible curtain wall system of claim 3 wherein said vertical linkage assemblies are weight bearing.

6. The self-bearing flexible curtain wall system of claim 5 wherein a horizontal linkage assembly is operatively interposed between adjacent vertical members of horizontally adjacent cladding panels.

7. The self-bearing flexible curtain wall system of claim 6 wherein said vertical linkage assembly comprises opposingly paired brackets and a vertical pin receivable through a webbing of each of said opposingly paired brackets.

8. The self-bearing flexible curtain wall system of claim 7 wherein said webbing of each of said opposingly paired brackets includes a convex surface, said convex surfaces being in abutting engagement in said vertical linkage assembly.

9. The self-bearing flexible curtain wall system of claim 8 wherein said brackets are carried by said opposingly paired vertical members of said periphery of each panel of said matrix of unitized cladding panels.

10. The self-bearing flexible curtain wall system of claim 8 wherein said brackets are integral to said opposingly paired horizontal members of said periphery of each panel of said matrix of unitized cladding panels.

11. The self-bearing flexible curtain wall system of claim 6 wherein said horizontal linkage assembly comprises a pin, said opposingly paired vertical members adapted to receive opposing portions of said pin.

12. The self-bearing flexible curtain wall system of claim 11 wherein said opposingly paired vertical members are further adapted to retain at least one of said opposing portions of said pin.

13. The self-bearing flexible curtain wall system of claim 12 wherein said opposingly paired vertical members are further adapted to secure at least one of said opposing portions of said pin.

14. The self-bearing flexible curtain wall system of claim 13 wherein said at least one of said opposing portions of said pin is threaded for receipt by one of said opposingly paired vertical members.

15. The self-bearing flexible curtain wall system of claim 12 wherein said pin is centrally articulated.

16. The self-bearing flexible curtain wall system of claim 11 wherein said pin is centrally articulated.

17. The self-bearing flexible curtain wall system of claim 6 wherein an anchor fixture is rigidly affixed to upper horizontal members of horizontally adjacent cladding panels of said matrix of unitized cladding panels.

18. The self-bearing flexible curtain wall system of claim 17 wherein said anchor fixture is adapted to respondingly engage the structural member.

19. The self-bearing flexible curtain wall system of claim 18 wherein said anchor fixture includes a pair of cladding panel brackets, each bracket of said pair of cladding panel brackets being vertically pivotable and horizontally translatable upon a yoke.

20. The self-bearing flexible curtain wall system of claim 19 wherein said yoke is horizontally pivotable relative to said anchor bracket about a yoke pivot axis.

21. The self-bearing flexible curtain wall system of claim 20 wherein said open end of said anchor bracket is pivotably supported by a clamp adapted to slidingly engage the prestressed cable, said anchor bracket being vertically rotatable about an anchor bracket pivot axis.

22. The self-bearing flexible curtain wall system of claim 19 wherein said yoke is pivotably supported on an anchor bracket for rotation with respect thereto, adjacent panels being thereby mutually rotatably in plan of said matrix of unitized cladding panels.

23. The self-bearing flexible curtain wall system of claim 22 wherein said anchor bracket includes a closed end opposite an open end, said open end being in abutting engagement with said yoke.

24. The self-bearing flexible curtain wall system of claim 23 wherein said clamp is supported by said matrix of unitized cladding panels.

* * * * *